US008904946B2

(12) United States Patent
Ihira et al.

(10) Patent No.: US 8,904,946 B2
(45) Date of Patent: Dec. 9, 2014

(54) UPPER FEED DEVICE AND SEWING MACHINE

(71) Applicants: Yuki Ihira, Kakamigahara (JP); Midori Magara, Nagoya (JP)

(72) Inventors: Yuki Ihira, Kakamigahara (JP); Midori Magara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/020,040

(22) Filed: Sep. 6, 2013

(65) Prior Publication Data

US 2014/0090586 A1 Apr. 3, 2014

(30) Foreign Application Priority Data

Sep. 28, 2012 (JP) ..... 2012-218478

(51) Int. Cl.

| | |
|---|---|
| ***D05B 27/10*** | (2006.01) |
| ***D05B 27/04*** | (2006.01) |
| ***D05B 27/08*** | (2006.01) |
| ***D05B 69/12*** | (2006.01) |
| *D05B 29/12* | (2006.01) |

(52) U.S. Cl.

CPC ..... *D05B 27/04* (2013.01); *D05B 27/08* (2013.01); *D05B 69/12* (2013.01)

USPC ..... 112/318

(58) Field of Classification Search

USPC ..... 112/303, 304, 312–322

See application file for complete search history.

(56) References Cited

U.S. PATENT DOCUMENTS

| | | | | | |
|---|---|---|---|---|---|
| 1,715,119 | A | * | 5/1929 | Clarkson | 112/2 |
| 4,072,115 | A | * | 2/1978 | Marforio | 112/309 |
| 4,187,795 | A | * | 2/1980 | Norton | 112/318 |
| 4,719,864 | A | * | 1/1988 | Barrett et al. | 112/470.06 |
| 4,928,611 | A | * | 5/1990 | Ogawa | 112/217 |
| 5,331,910 | A | * | 7/1994 | Mukai et al. | 112/470.32 |
| 6,415,727 | B1 | * | 7/2002 | Burgess et al. | 112/304 |

FOREIGN PATENT DOCUMENTS

| | | | |
|---|---|---|---|
| JP | 59149178 | A * | 8/1984 |
| JP | 359149178 | A * | 8/1984 |
| JP | A-59-164091 | | 9/1984 |
| JP | U-61-054771 | | 4/1986 |

(Continued)

OTHER PUBLICATIONS

U.S. Appl. No. 13/917,202, filed Jun. 13, 2013 in the name of Kato et al.

(Continued)

*Primary Examiner* — Ismael Izaguirre

(74) *Attorney, Agent, or Firm* — Oliff PLC

(57) ABSTRACT

An upper feed device is configured to be arranged above a bed of a sewing machine and feed a work cloth. The upper feed device includes a feed portion, a mechanism arrangement portion, and a drive portion. The feed portion includes a first feed mechanism and a second feed mechanism and is configured to feed the work cloth in a feed direction. The first feed mechanism and the second feed mechanism are arranged side by side in a first direction, which is parallel to a top surface of the bed and orthogonal to the feed direction. The mechanism arrangement portion is configured to arrange the first feed mechanism and the second feed mechanism in different positions in a second direction, which is orthogonal to the top surface of the bed. The drive portion is configured to drive the first feed mechanism and the second feed mechanism in synchronization.

3 Claims, 10 Drawing Sheets

(56) References Cited

FOREIGN PATENT DOCUMENTS

| | | |
|---|---|---|
| JP | A-62-129092 | 6/1987 |
| JP | A-04-348792 | 12/1992 |
| JP | A-05-269282 | 10/1993 |
| JP | A-2004-223005 | 8/2004 |

OTHER PUBLICATIONS

U.S. Appl. No. 13/777,598, filed Feb. 26, 2013 in the name of Magara et al.

* cited by examiner

UPPER FEED DEVICE AND SEWING MACHINE

CROSS-REFERENCE TO RELATED APPLICATION

This application claims priority to Japanese Patent Application No. 2012-218478 filed Sep. 28, 2012, the content of which is hereby incorporated herein by reference.

BACKGROUND

The present disclosure relates to an upper feed device that is disposed above a bed portion of a sewing machine and is configured to feed a work cloth, and relates to a sewing machine that includes the upper feed device.

An upper feed device of a sewing machine is known that is disposed above a bed portion of the sewing machine and that can feed a work cloth in coordination with a feed dog. For example, a known presser foot with a belt feed device includes two left and right belts for feeding a cloth. The sewing machine can feed the work cloth by the belts of the presser foot operating in coordination with the feed dog.

SUMMARY

When there is a difference in thickness between the left and right sides of the work cloth, which is a sewing object, one of the left and right belts may press the work cloth, but the other belt may be separated from the work cloth. Therefore, the work cloth may not be fed properly.

Embodiments of the broad principles derived herein provide an upper feed device and a sewing machine that enable a work cloth to be fed properly when the work cloth has a thickness difference.

Embodiments provide an upper feed device that is configured to be arranged above a bed of a sewing machine and that is configured to feed a work cloth. The upper feed device includes a feed portion, a mechanism arrangement portion, and a drive portion. The feed portion includes a first feed mechanism and a second feed mechanism and is configured to feed the work cloth in a feed direction. The first feed mechanism and the second feed mechanism are arranged side by side in a first direction. The first direction is a direction that is parallel to a top surface of the bed and that is orthogonal to the feed direction. The mechanism arrangement portion is configured to arrange the first feed mechanism and the second feed mechanism in different positions in a second direction. The second direction is a direction orthogonal to the top surface of the bed. The drive portion is configured to drive the first feed mechanism and the second feed mechanism of the feed portion in synchronization.

Embodiments also provide a sewing machine that includes a bed and an upper feed device. The upper feed device is arranged above the bed and is configured to feed a work cloth. The upper feed device includes a feed portion, a mechanism arrangement portion, and a drive portion. The feed portion includes a first feed mechanism and a second feed mechanism and is configured to feed the work cloth in a feed direction. The first feed mechanism and the second feed mechanism are arranged side by side in a first direction. The first direction is a direction that is parallel to a top surface of the bed and that is orthogonal to the feed direction. The mechanism arrangement portion is configured to arrange the first feed mechanism and the second feed mechanism in different positions in a second direction. The second direction is a direction orthogonal to the top surface of the bed. The drive portion is configured to drive the first feed mechanism and the second feed mechanism of the feed portion in synchronization.

BRIEF DESCRIPTION OF THE DRAWINGS

Embodiments will be described below in detail with reference to the accompanying drawings in which.

DETAILED DESCRIPTION

Hereinafter, an embodiment will be explained with reference to the drawings. A sewing machine 1 according to the present embodiment can form a stitch on a work cloth by moving the work cloth in relation to a needle that is moved up and down. The sewing machine 1 according to the present embodiment is an example of a sewing machine to which an upper feed device 4, which will be described below, can be mounted.

Figure 1:
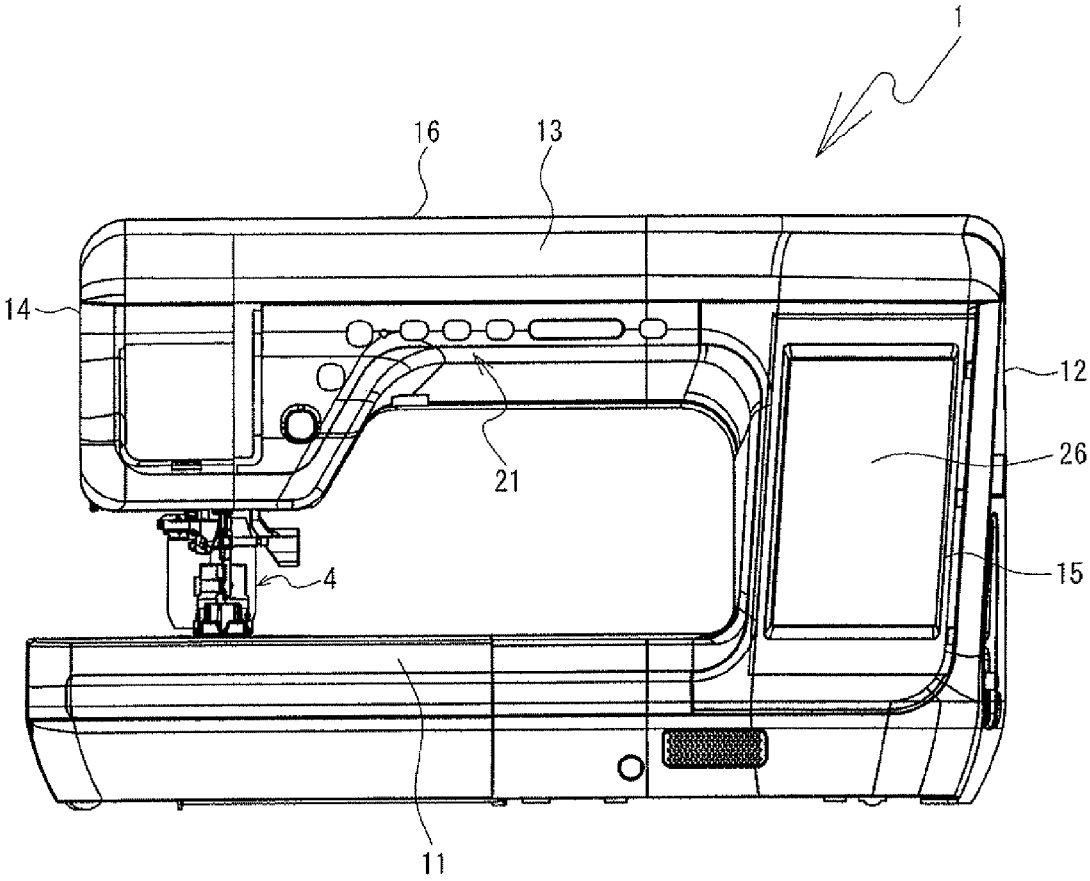
FIG. 1 is a front view of a sewing machine.

A physical structure of the sewing machine 1 will be explained with reference to FIGS. 1 to 3. In the following explanation, the near side, the far side, the upper side, the lower side, the left side, and the right side of FIG. 1 are respectively defined as the front side, the rear side, the upper side, the lower side, the left side, and the right side of the sewing machine 1. In other words, a direction in which a pillar 12, which will be explained below, extends is the up-down direction of the sewing machine 1. A longitudinal direction of a bed 11 and an arm 13 is the left-right direction of the sewing machine 1. A surface on which a switch cluster 21 is arranged is the front surface of the sewing machine 1.

Figure 2:
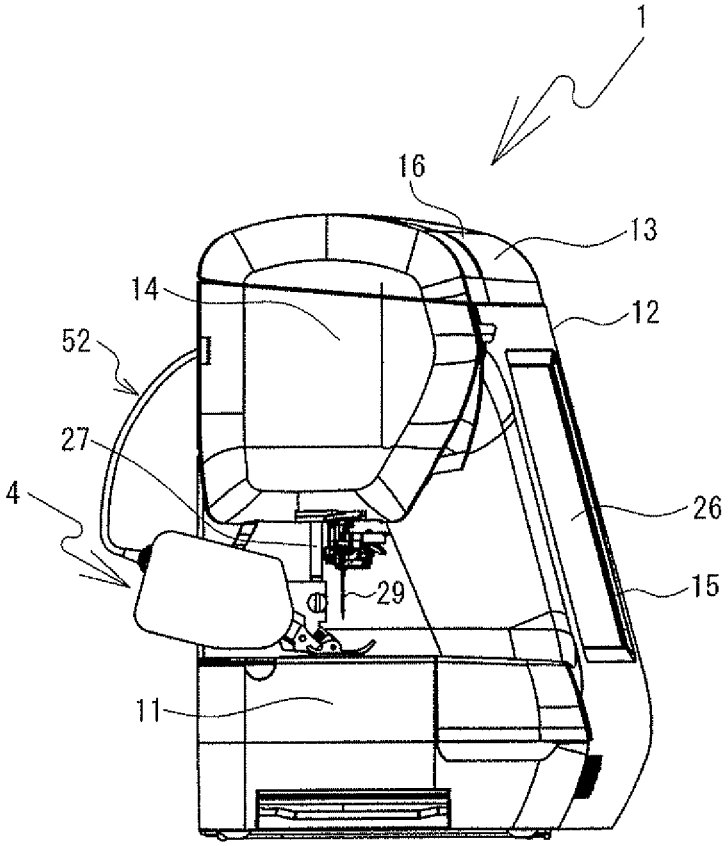
FIG. 2 is a left side view of the sewing machine.
Figure 3:
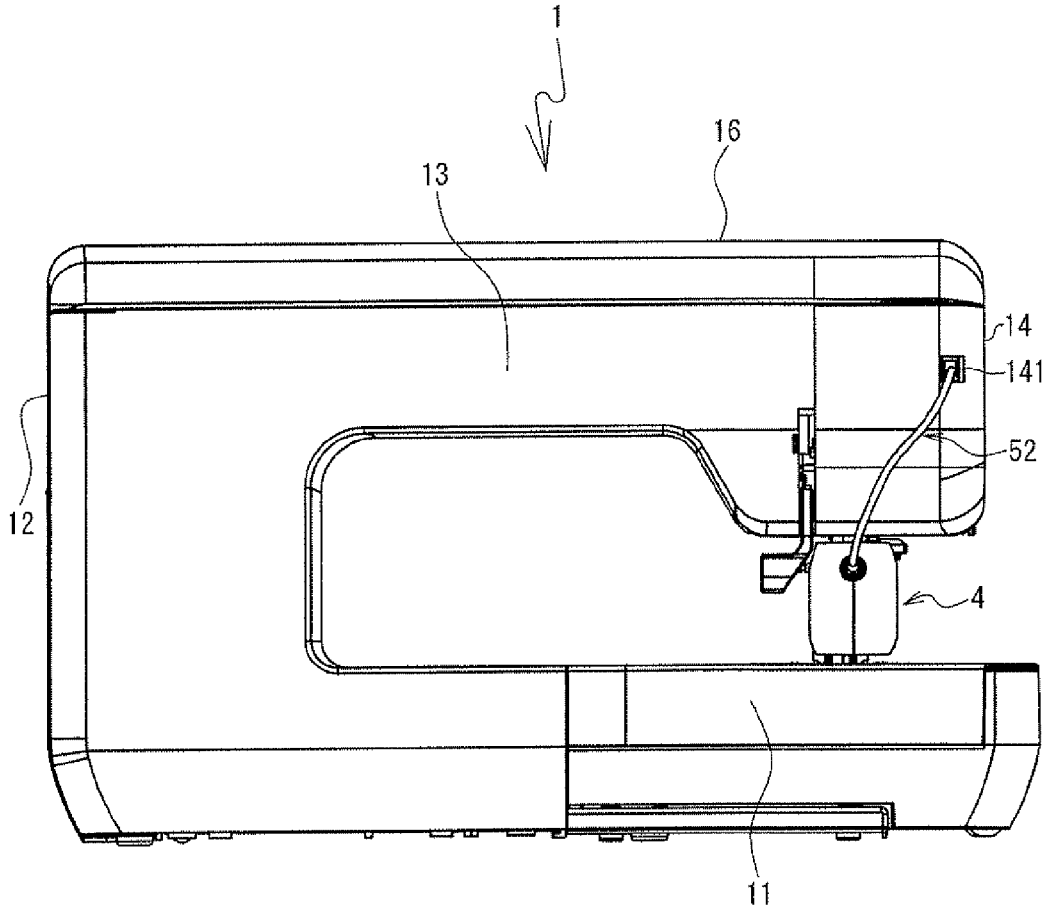
FIG. 3 is a rear view of the sewing machine.

As shown in FIGS. 1 to 3, the sewing machine 1 includes the bed 11, the pillar 12, the arm 13, and a head 14. The bed 11 extends in the left-right direction. The pillar 12 extends upward from the right end of the bed 11. The arm 13 extends toward the left from the top end of the pillar 12. The head 14 is provided on the left end of the arm 13. The bed 11 is provided with a needle plate 33 (refer to FIG. 9), a feed dog 34 (refer to FIGS. 9 and 10), a cloth feed mechanism (not shown in the drawings), a feed adjustment motor 78 (refer to FIG. 8), and a shuttle mechanism (not shown in the drawings). The needle plate 33 is disposed on the top face of the bed 11. The feed dog 34 is provided inside the bed 11, more specifically, underneath the needle plate 33. The feed dog 34 may feed a work cloth 100 (refer to FIG. 9) that is placed on the top face of the bed 11 and the needle plate 33 by a specified feed amount. The feed adjustment motor 78 may adjust the feed amount.

The cloth feed mechanism drives the feed dog 34 such that the feed dog 34 is moved in the front-rear direction. The feed dog 34 may feed the work cloth 100 in the front-rear direction. A feed mechanism 8 (refer to FIG. 4) of the upper feed device 4, which will be described below, may feed the work cloth 100 in the front-rear direction. A needle bar mechanism (not shown in the drawings), a needle bar swinging mechanism (not shown in the drawings), a needle bar swinging motor 80 (refer to FIG. 8), and a thread take-up mechanism (not shown in the drawings) are provided in the head 14. The needle bar mechanism may drive a needle bar (not shown in the drawings) in the up-down direction. A sewing needle 29 (refer to FIG. 2) may be attached to the needle bar. The needle bar swinging mechanism may swing the needle bar to the left and to the right. The needle bar swinging motor 80 may drive the needle bar swinging mechanism, and thus a baseline position 90 (refer to FIG. 9), which indicates a needle drop point of the sewing needle 29, may be changed within a predetermined range L (refer to FIG. 9) in the left-right direction.

The liquid crystal display 15 has a vertical rectangular shape and is provided on the front face of the pillar 12. For example, keys that are used to execute various functions necessary to the sewing operation, various messages, and various patterns etc. may be displayed on the liquid crystal display 15. A transparent touch panel 26 is provided on the upper surface (front surface) of the liquid crystal display 15. A user may perform an operation of pressing the touch panel 26, using the user's finger or a dedicated touch pen, in a position corresponding to one of the various keys or the like displayed on the liquid crystal display 15 so that the user may perform selection of a sewing pattern (a sewing data table), various settings, and the like.

The structure of the arm 13 will be explained. A cover 16 is attached to the upper portion of the arm 13 along the longitudinal direction of the arm 13. The cover 16 is supported such that the cover 16 can be opened and closed by being rotated about an axis that extends in the left-right direction at the upper rear edge of the arm 13. A thread container portion (not shown in the drawings) is provided close to the middle of the top of the arm 13 under the cover 16. The thread container portion is a recessed portion for containing a thread spool (not shown in the drawings). A spool pin (not shown in the drawings) is provided in the thread container portion. A thread spool may be mounted to the spool pin. The head 14 is provided with thread guides that include a tensioner, a thread take-up spring, a thread take-up lever, and the like, which are not shown in the drawings. An upper thread (not shown in the drawings) may be supplied from the thread spool via the thread guides to the sewing needle 29 that is attached to the needle bar.

A sewing machine motor 79 (refer to FIG. 8) is provided inside the pillar 12. The sewing machine motor 79 may rotate a drive shaft (not shown in the drawings) of the sewing machine 1. The drive shaft extends in the direction in which the arm 13 extends. The needle bar mechanism and the thread take-up mechanism may be driven by the rotating of the drive shaft. The switch cluster 21 is provided on the lower part of the front face of the arm 13. The switch cluster 21 includes a sewing start/stop switch, a reverse stitch switch, a needle up/down switch, and the like.

A presser bar 27 (refer to FIGS. 2 and 4) is located at the rear of the needle bar. The upper feed device 4 may be mounted to the lower end of the presser bar 27. The upper feed device 4 may be positioned above the bed 11. The upper feed device 4 may feed the work cloth 100 by operating in coordination with the feed dog 34.

Figure 4:
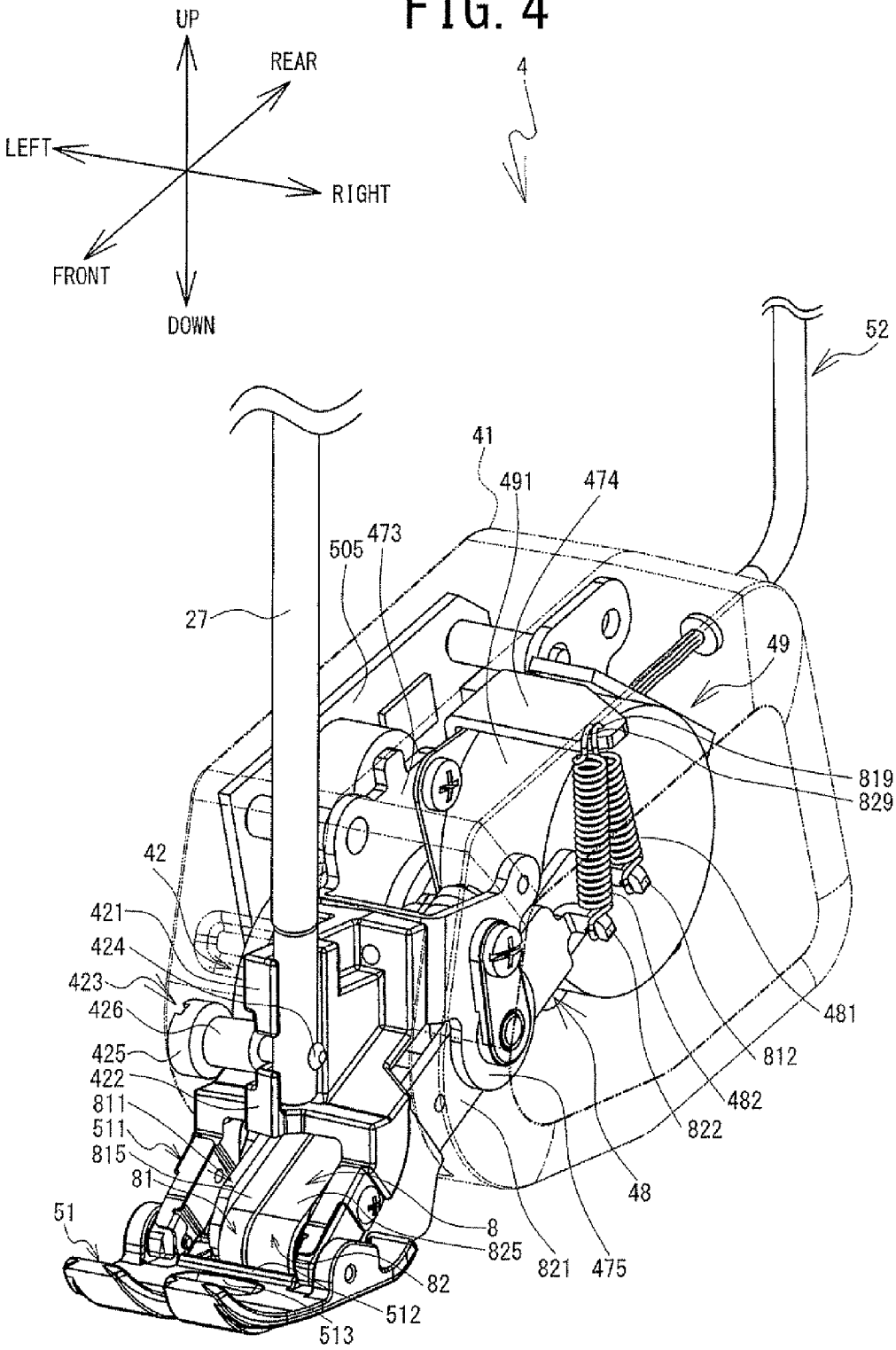
FIG. 4 is a perspective view showing an internal structure of an upper feed device.
Figure 5:
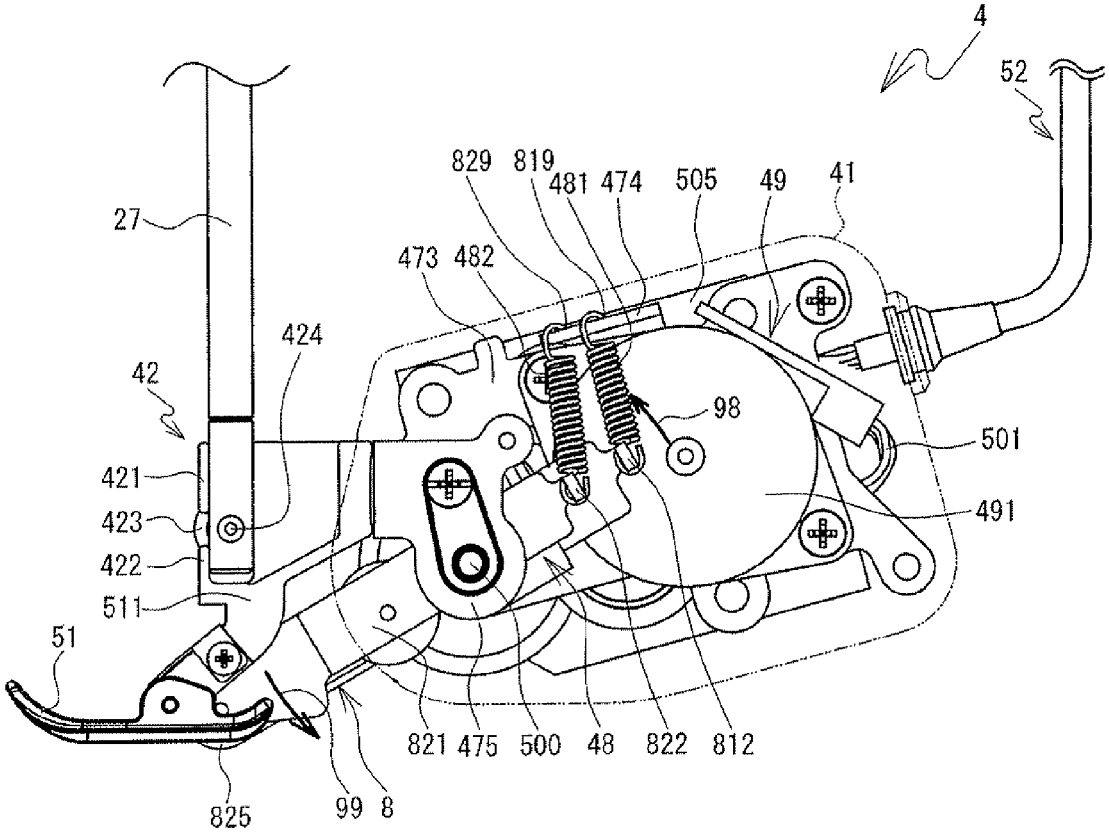
FIG. 5 is a right side view showing the internal structure of the upper feed device.

The upper feed device 4 will be explained with reference to FIGS. 4 to 7. As shown in FIGS. 4 and 5, the upper feed device 4 includes a housing 41, a mounting portion 42, the feed mechanism 8, a mechanism arrangement portion 48, a drive mechanism 49, a connecting portion 52, and a presser foot 51. The mounting portion 42 is a portion by which the upper feed device 4 can be mounted on the presser bar 27 of the sewing machine 1. The feed mechanism 8 may be disposed above the bed 11. The feed mechanism 8 may feed the work cloth 100 that is placed on the bed 11 in the front-rear direction. The drive mechanism 49 may drive the feed mechanism 8. The connecting portion 52 may electrically connect a motor 491, which is provided in the drive mechanism 49, to a control portion 60 (refer to FIG. 8) of the sewing machine 1.

The feed mechanism 8 and the mechanism arrangement portion 48 will be explained. The feed mechanism 8 includes a first feed mechanism 81 and a second feed mechanism 82. In a posture in which the upper feed device 4 is arranged above the bed 11, the first feed mechanism 81 and the second feed mechanism 82 may be arranged side by side in a first direction (the left-right direction), which is a direction parallel to the top surface of the bed 11 and orthogonal to a feed direction (the front-rear direction). The feed direction is a driving direction to feed the work cloth 100. The first feed mechanism 81 is arranged on the left side in the first direction and the second feed mechanism 82 is arranged on the right side in the first direction. The mechanism arrangement portion 48 can arrange the first feed mechanism 81 and the second feed mechanism 82 in different positions in an orthogonal direction (the up-down direction) that is orthogonal to the top surface of the bed 11 (refer to FIG. 9).

The mechanism arrangement portion 48 includes a first rotating plate portion 811, a second rotating plate portion 821, a first spring 481, and a second spring 482. The first feed mechanism 81 is supported by the first rotating plate portion 811. The second feed mechanism 82 is supported by the second rotating plate portion 821.

Figure 6:
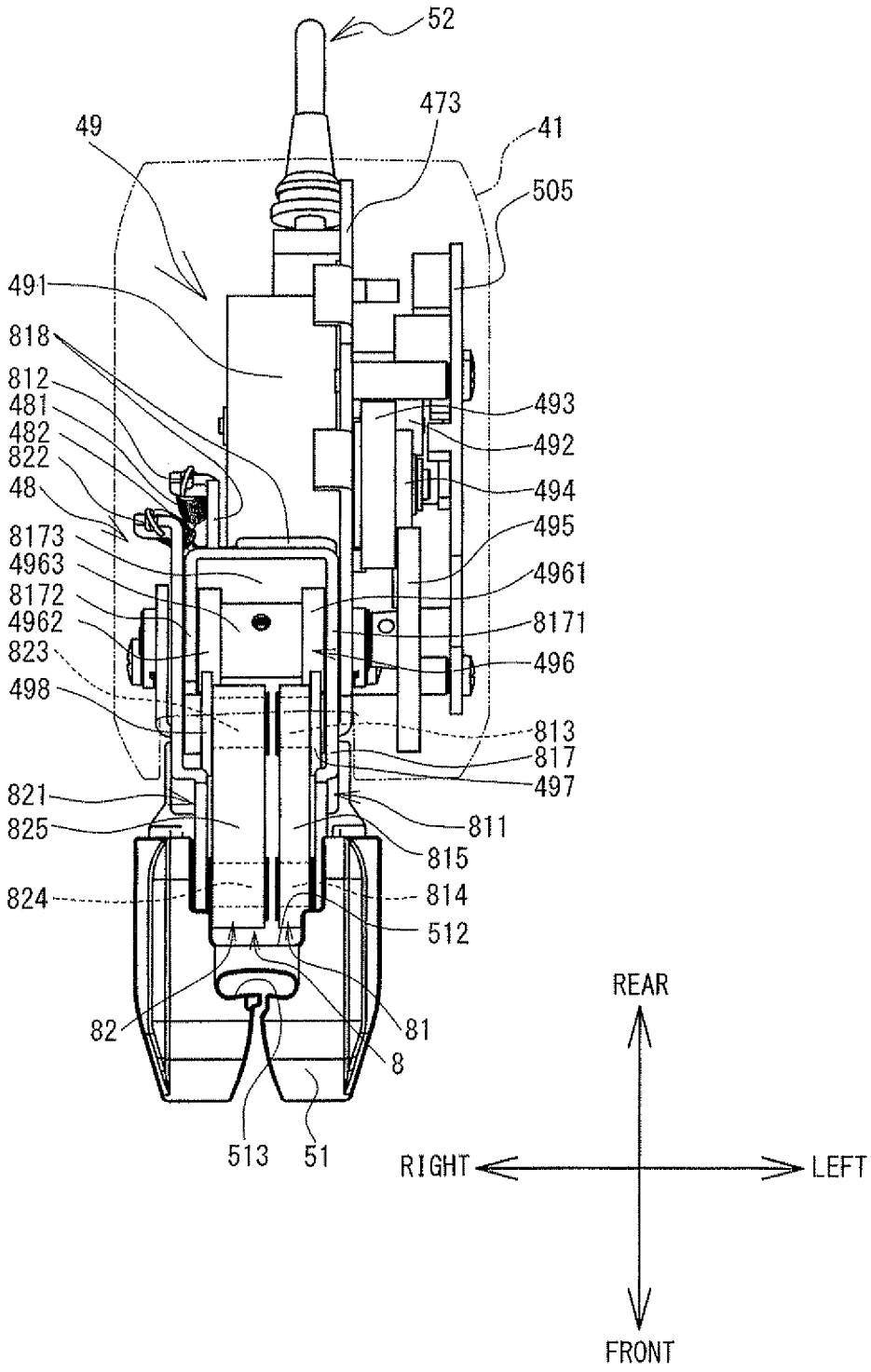
FIG. 6 is a bottom view showing the internal structure of the upper feed device.
Figure 7:
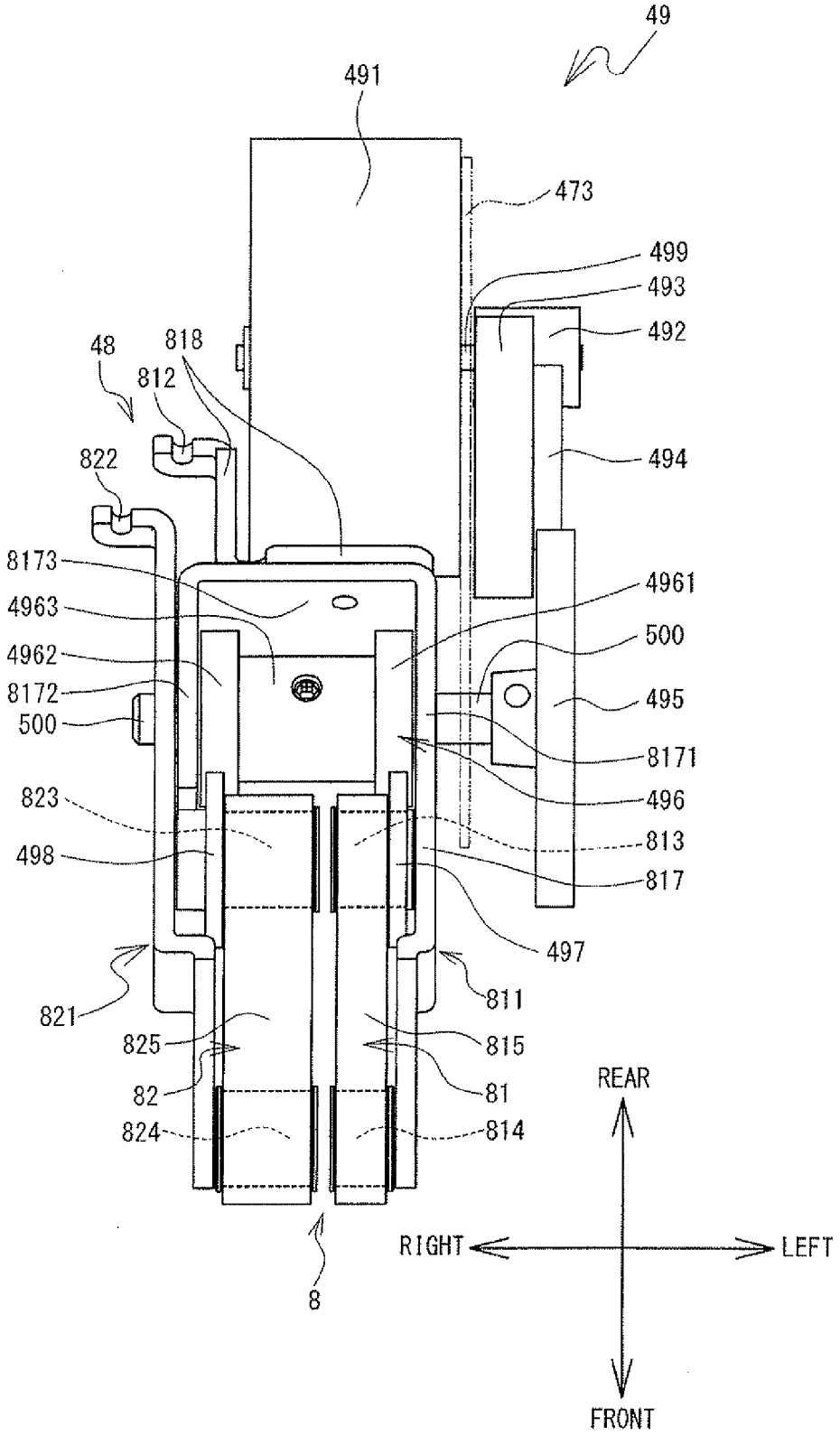
FIG. 7 is a bottom view showing a transmission path of power from a motor.

As shown in FIGS. 6 and 7, the first rotating plate portion 811 includes a plate portion 817 and a plate portion 818. The plate portion 818 includes a first spring hook portion 812. The first spring hook portion 812 is located at the right of the motor 491. The plate portion 818 extends obliquely forward and downward from the first spring hook portion 812. Then, the plate portion 818 bends to the left in front of and below the motor 491, and extends to the left. The plate portion 817 includes a plate portion 8171, a plate portion 8172, and a plate portion 8173. The plate portion 8173 is a portion that forms a rear end portion of the plate portion 817, and extends in the left-right direction. A part of the plate portion 818 that extends to the right is coupled to the plate portion 8173 using a screw (not shown in the drawings). The plate portion 8172 is a portion that forms a right end portion of the plate portion 817. The plate portion 8172 extends obliquely forward and downward from a right end portion of the plate portion 8173. A front end portion of the plate portion 8172 is located at the right of a gear 496 (which will be described below). The plate portion 8171 is a portion that forms a left end portion of the plate portion 817. The plate portion 8171 extends obliquely forward and downward from a left end portion of the plate portion 8173. A front end portion of the plate portion 8171 is located in a belt arrangement portion 512 of the presser foot 51 (refer to FIG. 6).

The second rotating plate portion 821 includes a second spring hook portion 822. The second spring hook portion 822 is located at the right of the motor 491. The second rotating plate portion 821 extends obliquely forward and downward from the second spring hook portion 822. A front end portion of the second rotating plate portion 821 is located in the belt arrangement portion 512 of the presser foot 51 (refer to FIG. 6).

A hole (not shown in the drawings) that penetrates in the left-right direction is provided in a central portion in the front-rear direction of each of the first rotating plate portion 811 and the second rotating plate portion 821. A central shaft 500 that is coupled to the gear 495 is inserted into the hole (refer to FIG. 7). The first rotating plate portion 811 and the second rotating plate portion 821 can be rotated around the central shaft 500.

The arrangement of the first spring 481 and the second spring 482 will be explained. As shown in FIG. 4, a plate portion 473 that extends in the up-down direction and the front-rear direction is provided at the left of the motor 491. An extending portion 474 that extends to the right is provided in a central portion in the front-rear direction of the upper end of the plate portion 473. The extending portion 474 is located above the motor 491. A right end portion of the extending portion 474 is provided with two holes 819 and 829. The holes 819 and 829 penetrate the extending portion 474 in the up-down direction. The hole 819 is located at the rear of the hole 829.

An upper end portion of the first spring 481 is fixed to the hole 819. The first spring 481 extends downward. A lower end portion of the first spring 481 is fixed to the first spring hook portion 812 of the first rotating plate portion 811. An upper end portion of the second spring 482 is fixed to the hole 829. The second spring 482 extends downward. A lower end portion of the second spring 482 is fixed to the second spring hook portion 822 of the second rotating plate portion 821. The first spring 481 and the second spring 482 are provided in an extended state, and a force in a contraction direction is constantly generated. Therefore, the first spring 481 upwardly pulls the first spring hook portion 812 provided at a rear end portion of the first rotating plate portion 811 (refer to an arrow 98 in FIG. 5). The second spring 482 upwardly pulls the second spring hook portion 822 provided at a rear end portion of the second rotating plate portion 821 (refer to the arrow 98 in FIG. 5). Although details will be described below, since the first spring hook portion 812 and the second spring hook portion 822 are pulled in the upward direction, the first feed mechanism 81 and the second feed mechanism 82 may press the work cloth 100.

The first feed mechanism 81 and the second feed mechanism 82 of the feed mechanism 8 will be explained. As shown in FIGS. 6 and 7, the first feed mechanism 81 includes a first drive pulley 813, a first driven pulley 814, and a first belt 815. The first drive pulley 813 is a pulley that can be rotated by rotational force of the motor 491. The first driven pulley 814 is a pulley that is separated from the first drive pulley 813 and that is rotatably supported.

The first drive pulley 813 and the first driven pulley 814 are supported by the first rotating plate portion 811. More specifically, the front end portion of the plate portion 8171 rotatably supports the first driven pulley 814. A central portion, in the front-rear direction, of the plate portion 8171 rotatably supports the first drive pulley 813. The first belt 815 is provided around the first drive pulley 813 and the first driven pulley 814. The first belt 815 can be driven by rotation of the first drive pulley 813. A front end portion of the first belt 815 is located in the belt arrangement portion 512 of the presser foot 51 (refer to FIG. 6). The first belt 815 may press the work cloth 100 and feed the work cloth 100 in the front-rear direction, which is the feed direction.

The second feed mechanism 82 includes a second drive pulley 823, a second driven pulley 824 and a second belt 825. The second drive pulley 823 is a pulley that can be rotated by the rotational force of the motor 491. The second driven pulley 824 is a pulley that is separated from the second drive pulley 823 and that is rotatably supported.

The second rotating plate portion 821 supports the second drive pulley 823 and the second driven pulley 824. More specifically, the front end portion of the second rotating plate portion 821 rotatably supports the second driven pulley 824. A central portion, in the front-rear direction, of the second rotating plate portion 821 rotatably supports the second drive pulley 823. The second belt 825 is provided around the second drive pulley 823 and the second driven pulley 824. The second belt 825 can be driven by rotation of the second drive pulley 823. A front end portion of the second belt 825 is located in the belt arrangement portion 512 of the presser foot 51 (refer to FIG. 6). The second belt 825 may press the work cloth 100 and feeds the work cloth 100 in the front-rear direction, which is the feed direction.

The width of the first belt 815 and the width of the second belt 825 will be explained. As shown in FIG. 9, the widths, in the first direction (the left-right direction), of the first belt 815 and the second belt 825 are different from each other. More specifically, the width of the first belt 851 is smaller than the width of the second belt 825. As described above, the needle bar swinging motor 80 (refer to FIG. 8) may drive the needle bar swinging mechanism (not shown in the drawings), and thus the baseline position 90, which indicates the needle drop point of the sewing needle 29, may be changed within the predetermined range L in the first direction (refer to FIG. 9).

In the explanation below, the baseline position 90 in the center of the predetermined range L is referred to as a center baseline position 901. The baseline position 90 on one side (the left side in the present embodiment), in the first direction, within the predetermined range L is referred to as a left baseline position 902. The baseline position 90 on the other side (the right side in the present embodiment), in the first direction, within the predetermined range L is referred to as a right baseline position 903. For example, when a user performs sewing of a straight line pattern on the work cloth 100, the user may appropriately select the baseline position 90 corresponding to a working mode. When the sewing is performed with the sewing machine 1, straight line stitches (hereinafter referred to as straight stitches) may be formed on the work cloth 100 in one of the baseline positions 901, 902 and 903 while the work cloth 100 is being fed one of forward and rearward. The width of the first belt 815 is set such that the first belt 815 may press straight stitches that are formed on the work cloth 100 in the left baseline position 902. The width of the second belt 825 is set such that the second belt 825 may press straight stitches that are formed on the work cloth 100 in the right baseline position 903 and in the center baseline position 901.

The mounting portion 42 and the presser foot 51 will be explained. As shown in FIG. 4, the mounting portion 42 is provided above the feed mechanism 8 in the front end portion of the upper feed device 4. The mounting portion 42 includes two holding portions 421 and 422. The holding portions 421 and 422 may be mounted on and fixed to the presser bar 27 by a shoulder screw 423. The shoulder screw 423 includes a head 425, a shank 426, and a threaded portion 424. The outside diameter of the shank 426 is slightly smaller than the outside diameter of the head 425. The outside diameter of the threaded portion 424 is slightly smaller than the outside diameter of the shank 426. The holding portions 421 and 422 are provided on the front end of the upper feed device 4. The holding portion 421 is provided above the holding portion 422 and is slightly separated from the holding portion 422. Each of the holding portions 421 and 422 has a recessed portion that is recessed toward the left. The lower end portion of the presser bar 27 may be disposed in the recessed portions. A threaded hole (not shown in the drawings) is provided in the lower end portion of the presser bar 27. The threaded hole extends through the presser bar 27 in the left-right direction. The threaded portion 424 may be screwed into the threaded hole. A slot (not shown in the drawings) is formed in the left side face of the head 425. A tool (not shown in the drawings), which will be described below, may be fitted into the slot.

When the upper feed device 4 is mounted on the presser bar 27, the user may adjust the position of the threaded portion 424 to the screw hole portion of the presser bar 27. In this state, the user may rotate the head 425 using the user's fingers or fit the tool into the slot to rotate the head 425. As a result of this, a right side surface (the right side surface excluding the threaded portion 424) of the shank 426 may come into contact with left side surfaces of the holding portions 421 and 422. Further, if the shoulder screw 423 is rotated and tightened in this state, the holding portions 421 and 422 may be clamped between the shank 426 and the presser bar 27. In this state, the holding portions 421 and 422 are fixed to the presser bar 27. The upper feed device 4 may thus be mounted on the presser bar 27.

As shown in FIG. 4, a presser foot support portion 511 is provided at a lower end portion of the holding portion 422 on the lower side. The presser foot support portion 511 straddles a front end portion of the feed mechanism 8 in the left-right direction. The presser foot support portion 511 extends obliquely downward and forward. The presser foot 51 is provided at a lower end portion of the presser foot support portion 511. The sewing needle 29 may pass through a hole 513 of the presser foot 51. The belt arrangement portion 512 is provided to the rear of the hole 513 (refer to FIG. 6). The belt arrangement portion 512 is a rectangular open portion that extends to the rear edge of the presser foot 51. The front end portions of the first belt 815 and the second belt 825 of the feed mechanism 8 are arranged on the inner side of the belt arrangement portion 512. A section of the first belt 815 that is lower than the first driven pulley 814 and a section of the second belt 825 that is lower than the second driven pulley 824 may feed the work cloth 100 while pressing the work cloth 100 downward in the belt arrangement portion 512.

The upper feed device 4 may be mounted on the presser bar 27 by the mounting portion 42. Therefore, when the presser bar 27 is moved upward, the upper feed device 4 is also moved upward, and the presser foot 51, the first feed mechanism 81, and the second feed mechanism 82 may be separated from the work cloth 100. When the presser bar 27 is moved downward, the upper feed device 4 is also moved downward, and the presser foot 51, the first feed mechanism 81, and the second feed mechanism 82 may press the work cloth 100 downward.

The drive mechanism 49 will be explained. As shown in FIG. 7, the drive mechanism 49 includes the motor 491, gears 492 to 498, and an electrical substrate 505 (refer to FIG. 4). The motor 491 is located at the right of the plate portion 473 (refer to FIGS. 4 and 7). A drive shaft 499 of the motor 491 protrudes to the left of the plate portion 473 through the plate portion 473 (refer to FIG. 7). The gear 492 is firmly fixed to the leading end of the drive shaft 499. The gear 493 is located in front of and below the gear 492. The gear 492 is meshed with the gear 493. The gear 494 is provided on a left side surface of the gear 493. The diameter of the gear 494 is smaller than the diameter of the gear 493. The gear 493 and the gear 494 are formed as a single unit. The gear 493 and the gear 494 are rotatably supported by a support shaft (not shown in the drawings). The support shaft is provided on the plate portion 473 and extends to the left. The gear 495 is located in front of the gear 494. The gear 494 is meshed with the gear 495. The gear 495 is firmly fixed to the left end of the central shaft 500. The central shaft 500 passes through holes (not shown in the drawings) that are respectively provided in the first rotating plate portion 811 and the second rotating plate portion 821. In other words, the first rotating plate portion 811 and the second rotating plate portion 821 are respectively supported such that the first and second rotating plate portions 811 and 821 can be individually rotated around the central shaft 500. Although not shown in detail in the drawings, a section of the central shaft 500 that is provided between the gear 495 and the plate portion 8171 is rotatably supported by the plate portion 473. On the other hand, the right end of the central shaft 500 is rotatably supported by a receiving portion 475 (refer to FIGS. 4 and 5). The receiving portion 475 extends to the right from the plate portion 473.

The gear 496 is provided between the first rotating plate portion 811 and the second rotating plate portion 821. More specifically, the gear 496 is provided in a space between the plate portion 8171 and the plate portion 8172. The gear 496 includes a gear 4961, a gear 4962, and a cylindrical portion 4963, which are formed as a single unit. The cylindrical portion 4963 extends in the left-right direction between the plate portion 8171 and the plate portion 8272. The gear 4961 protrudes outwardly in a radial direction from the left end of the cylindrical portion 4963. The gear 4962 protrudes outwardly in a radial direction from the right end of the cylindrical portion 4963. A through hole (not shown in the drawings) is formed in the center of the gear 496. The central shaft 500 passes through the through hole. The dimension in the left-right direction of the gear 496 is slightly shorter than the dimension (the inner dimension) between the plate portion 8171 and the plate portion 8172. The gear 496 is fixed to the central shaft 500 by means of a locking screw (not shown in the drawings). The gear 495, the central shaft 500, and the gear 496 can thus be rotated integrally with each other.

The gear 4961 is meshed with the gear 497, which is located in front of the gear 4961. The gear 497 is formed as a single unit with the first drive pulley 813 of the feed mechanism 8. The gear 4962 is meshed with the gear 498, which is located in front of the gear 4962. The gear 498 is formed as a single unit with the second drive pulley 823 of the feed mechanism 8. Driving of the first belt 815 and the second belt 825 by the drive mechanism 49 will be described in detail below.

The electrical substrate 505 (refer to FIG. 4) is located at the left of the plate portion 473 and the gear 495. The motor 491 is connected to the electrical substrate 505 via a lead wire 501 (refer to FIG. 5).

Figure 8:
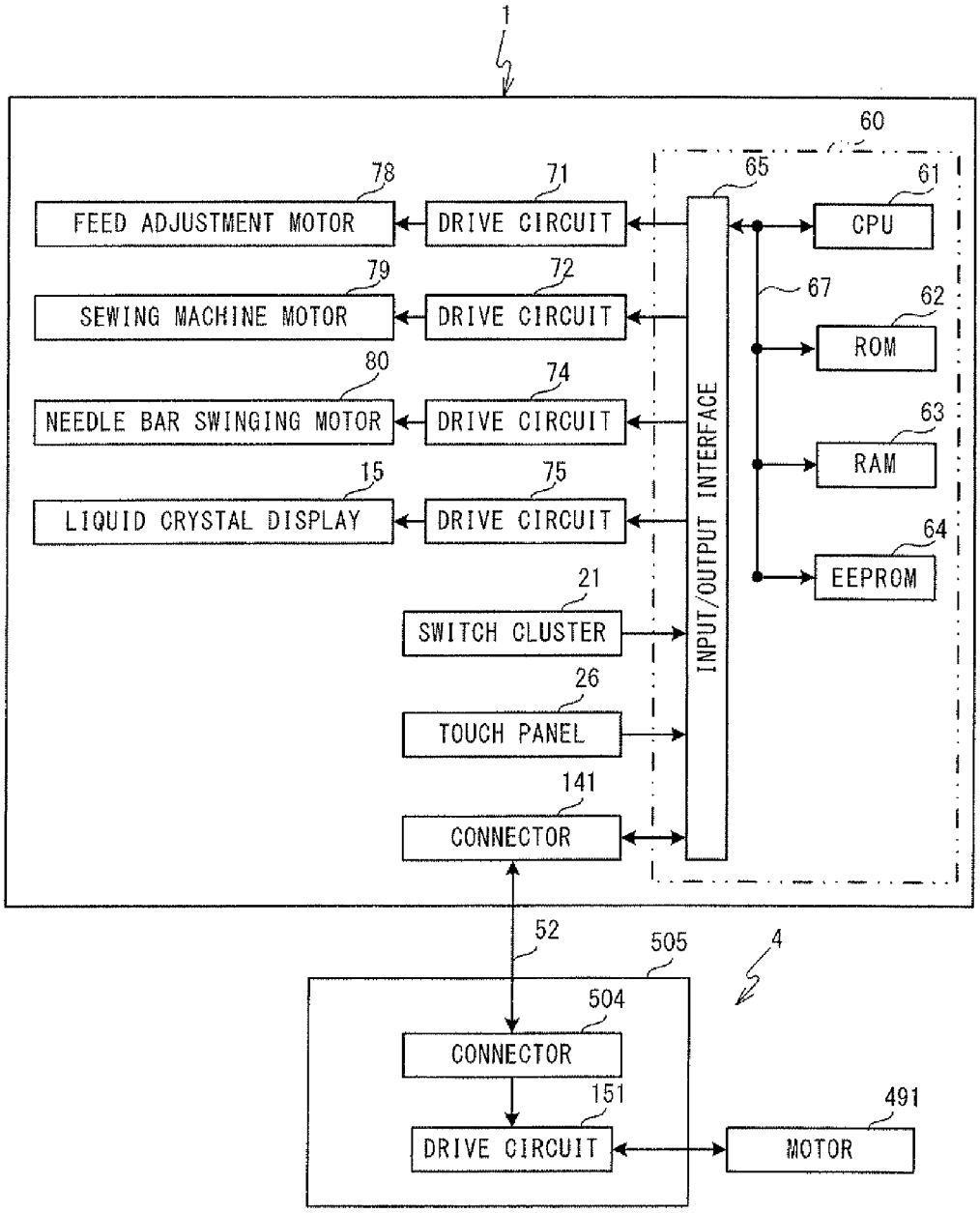
FIG. 8 is a block diagram of an electrical configuration of the sewing machine and the upper feed device.
Figure 9:
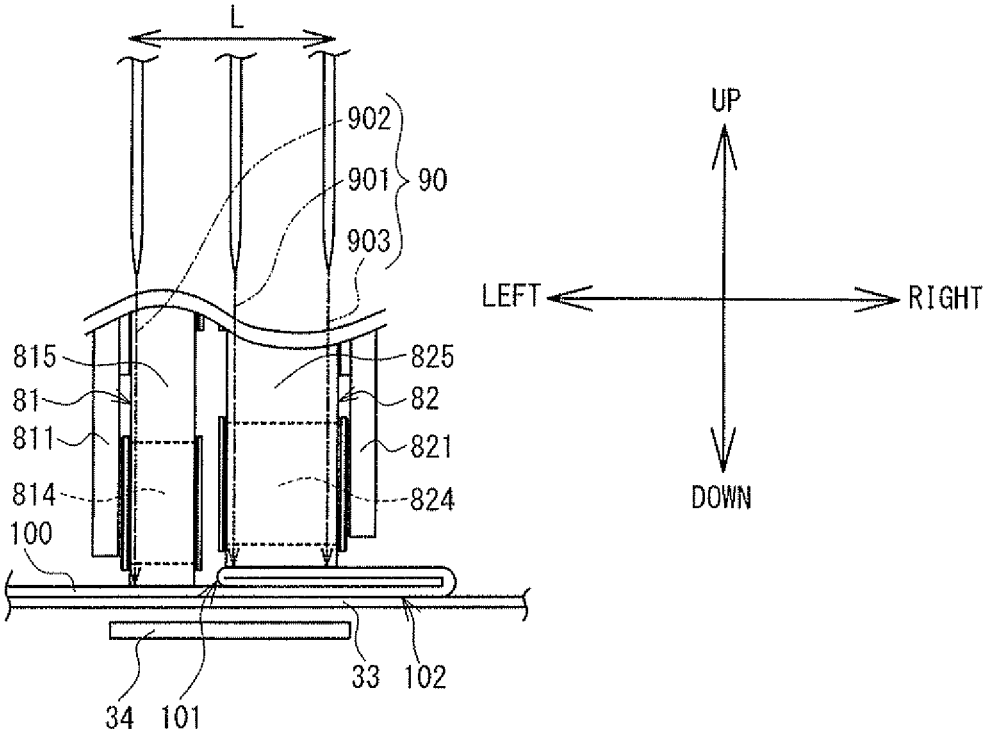
FIG. 9 is a partially enlarged view, as seen from the front, that shows a first feed mechanism and a second feed mechanism that press a work cloth having a thickness difference.

The connecting portion 52 is connected to the electrical substrate 505 via a connector 504 (refer to FIG. 8). The connecting portion 52 extends from the electrical substrate 505 to the outside of the housing 41 of the upper feed device 4 and may be connected to a connector 141 (refer to FIGS. 3 and 8). The connector 141 is provided in the head 14 of the sewing machine 1 and is electrically connected to the control portion 60 (refer to FIG. 8) of the sewing machine 1. The motor 491 may be electrically connected to the control portion 60 of the sewing machine 1 via the electrical substrate 505, the connecting portion 52, and the connector 141.

The electrical configuration of the sewing machine 1 will be explained with reference to FIG. 8. As shown in FIG. 8, the control portion 60 of the sewing machine 1 includes the CPU 61, a ROM 62, a RAM 63, the EEPROM 64, and an input/ output interface 65, all of which are connected to one another via a bus 67. ROM 62 stores programs for the CPU 61 to perform processing, as well as data and the like. EEPROM 64 stores various types of other data such as data that is used for sewing an embroidery pattern and the like. RAM 63 may store various types of temporary data.

The switch cluster 21, the touch panel 26, drive circuits 71, 72, 74, 75, and the connector 141 are electrically connected to the input/output interface 65. The drive circuit 71 may drive the feed adjustment motor 78. The drive circuit 72 may drive the sewing machine motor 79. The drive circuit 74 may drive the needle bar swinging motor 80. The drive circuit 75 may drive the liquid crystal display 15.

The connector 141 may be connected to one end of the connecting portion 52. The connecting portion 52 is connected to the connector 504. The connector 504 is electrically connected to a drive circuit 151. The connector 504 and the drive circuit 151 and are mounted on an electrical substrate 505. The drive circuit 151 may drive the motor 491. By controlling the drive circuit 151, the CPU 61 can control the driving of the motor 491.

The mode of feeding the work cloth 100 by the upper feed device 4 will be explained. First, a case in which the work cloth 100 has a thickness difference will be explained with reference to FIG. 9. As shown in FIG. 9, for example, a right end portion of the work cloth 100 is folded and the work cloth 100 is folded over into a layered section, so that a thickness difference 101 is formed. In the explanation below, the layered section of the right end portion of the work cloth 100 is referred to as a "folded section 102". The wok cloth 100 shown in FIG. 9 may be, for example, a fabric for trousers and the folded section 102 may be the hem of the trousers.

When the presser bar 27 is moved downward and the upper feed device 4 is moved downward, the presser foot 51 (refer to FIG. 5) may press the work cloth 100 downward. Further, due to a biasing force of the first spring 481, the rear end portion of the first rotating plate portion 811 is pulled upward (refer to the arrow 98 in FIG. 5). As a result, a counterclockwise force (in the right side view) around the central shaft 500 is applied to a front end portion of the first rotating plate portion 811. Thus, the first driven pulley 814 that is supported by the front end portion of the first rotating plate portion 811 may be biased toward the top surface of the work cloth 100 (refer to an arrow 99 in FIG. 5). Therefore, the section of the first belt 815 that is lower than the first driven pulley 814 may press the work cloth 100. In the example shown in FIG. 9, the first belt 815 may press a section of the work cloth 100 that is located at the left of the folded section 102.

In a similar manner, due to a biasing force of the second spring 482, the rear end portion of the second rotating plate portion 821 is pulled upward (refer to the arrow 98 in FIG. 5). As a result, the counterclockwise force (in the right side view) around the central shaft 500 is applied to the front end portion of the second rotating plate portion 821. Thus, the second driven pulley 824 that is supported by the front end portion of the second rotating plate portion 821 may be biased toward the top surface of the work cloth 100 (refer to the arrow 99 in FIG. 5). Therefore, the section of the second belt 825 that is lower than the second driven pulley 824 may press the work cloth 100. In the example shown in FIG. 9, the second belt 825 may press the folded section 102 of the work cloth 100.

When the motor 491 is driven in this state by control of the control portion 60 of the sewing machine 1, the first drive pulley 813 is rotated via the gears 492 to 495, 496, and 497. When the first drive pulley 813 is rotated, the first belt 815 is moved. In accordance with the movement of the first belt 815, the first driven pulley 814 is rotated. The first belt 815 may come into contact with the work cloth 100 and may be moved, thus feeding the work cloth 100.

In a similar manner, when the motor 491 rotates, the second drive pulley 823 is rotated via the gears 429 to 495, 4962 and 498. When the second drive pulley 823 is rotated, the second belt 825 is moved. In accordance with the movement of the second belt 825, the second driven pulley 824 is rotated. The second belt 825 may come into contact with the work cloth 100 and may be moved, thus feeding the work cloth 100. At this time, the gear 4961 and the gear 4962 are rotated integrally with each other. Therefore, the first belt 815 and the second belt 825 are moved in synchronization with each other. In other words, the motor 491 may synchronize and drive the first feed mechanism 81 and the second feed mechanism 82.

In a case where the work cloth 100 is fed in the front-rear direction, the control portion 60 can perform control that synchronizes the timing of the operation by which the upper feed device 4 feeds the work cloth 100 and the timing of the operation by which the feed dog 34 feeds the work cloth 100. Accordingly, the upper feed device 4 and the feed dog 34 can operate in coordination to feed the work cloth 100 in the front-rear direction.

Figure 10:
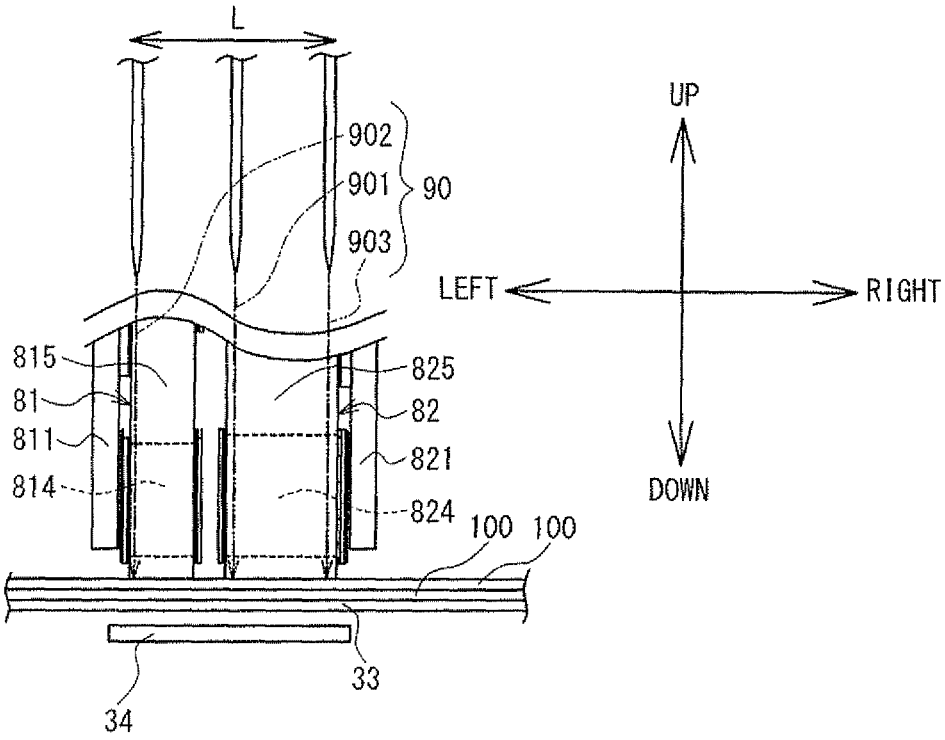
FIG. 10 is a partially enlarged view, as seen from the front, that shows the first feed mechanism and the second feed mechanism that press the work cloth having no thickness difference.

Next, with reference to FIG. 10, a case will be explained in which sewing is performed in a state in which the work cloth 100 has no thickness difference. For example, in FIG. 10, two sheets of the work cloth 100 are overlapped and no thickness difference is formed in the work cloth 100. In this case, the first belt 815 and the second belt 825 may press the work cloth 100, similarly to the case of FIG. 9. At this time, since no thickness difference is formed in the work cloth 100, the first belt 815 and the second belt 825 may downwardly press the work cloth 100 at the same position in the up-down direction. Then, the motor 491 may synchronize and drive the first feed mechanism 81 and the second feed mechanism 82. The work cloth 100 may be fed in the front-rear direction.

In the present embodiment, the first feed mechanism 81 and the second feed mechanism 82 can be arranged in different positions in the up-down direction. Therefore, even in the case in which the work cloth 100 has the thickness difference 101 as shown in FIG. 9, the first feed mechanism 81 and the second feed mechanism 82 can be arranged corresponding to the thickness difference 101 of the work cloth 100. Further, the first feed mechanism 81 and the second feed mechanism 82 can be driven in synchronization with each other. Therefore, even when the work cloth 100 has the thickness difference 101, it is possible to properly feed the work cloth 100.

Since the first spring 481 biases the first driven pulley 814 toward the top surface of the work cloth 100, the first belt 815 is biased and the work cloth 100 may be pressed. Since the second spring 482 biases the second driven pulley 824 toward the top surface of the work cloth 100, the second belt 825 is biased and the work cloth 100 may be pressed. The first belt 815 and the second belt 825 are separately biased and may press the work cloth 100. Therefore, even in the case in which the work cloth 100 has the thickness difference 101 as shown in FIG. 9, the first belt 815 and the second belt 825 can press the work cloth 100 corresponding to the thickness difference 101. Therefore, even when the work cloth 100 has the thickness difference 101, it is possible to properly feed the work cloth 100.

In the present embodiment, the width of the second belt 825 is set such that the second belt 825 may press straight stitches that are formed on the work cloth 100 in the right baseline position 903 and in the center baseline position 901. It is therefore possible to press the work cloth 100 in the vicinity of the needle drop point. As a result, sewing quality may be improved. Further, as shown in FIG. 9, when the second belt 825 is arranged on the folded section 102, an end portion of the folded section 102 that is provided with the thickness difference 101 can be arranged on straight stitches that are formed on the work cloth 100 in the center baseline position 901. Therefore, when sewing is performed in the center baseline position 901, it is possible to perform sewing while the second belt 825 is pressing the work cloth 100 reliably. It is therefore possible to perform sewing while reliably pressing the end portion that is provided with the thickness difference 101 where the cloth thickness is increased. As a result, it is possible to improve sewing quality.

The present disclosure is not limited to the above-described embodiment and various modifications are possible. For example, the width of the second belt 825 need not necessarily be set such that the second belt 825 may press the straight stitches that are formed on the work cloth 100 in the right baseline position 903 and in the center baseline position 901. For example, the width of the second belt 825 may be set such that the second belt 825 may press the straight stitches that are formed on the work cloth 100 in at least one of the right baseline position 903 and the center baseline position 901. In this case also, when sewing is performed in a baseline position that are set so that one of the first belt 815 and the second belt 825 may press the straight stitches, the one of the first belt 815 and the second belt 825 may be arranged to press the straight stitches formed on the work cloth 100. It is thus possible to press the work cloth 100 in the vicinity of the needle drop point. As a result, sewing quality is improved.

The width of the first belt 815 need not necessarily be smaller than the width of the second belt 825. For example, the width of the first belt 815 may be larger than the width of the second belt 825. In this manner, the width of the first belt 815 may be different from the width of the second belt 825. In this case, work efficiency of the user may be improved if the width of the first belt 815 and the width of the second belt 825 are set corresponding to a working mode. For example, in the example shown in FIG. 9, the upper feed device 4 may be used to take up the hem of the trousers. Further, for example, when a straight pattern (straight stitches) is not sewn in the center baseline position 901, the width of the first belt 815 may be the same as the width of the second belt 825.

The upper feed device 4 may be used when a pattern (stitches) other than the straight pattern (straight stitches) is sewn. For example, the upper feed device 4 may be used when a zigzag pattern is sewn.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An upper feed device that is configured to be arranged above a bed of a sewing machine and that is configured to feed a work cloth, the upper feed device comprising:

a feed portion that includes a first feed mechanism and a second feed mechanism and that is configured to feed the work cloth in a feed direction, the first feed mechanism and the second feed mechanism being arranged side by side in a first direction, and the first direction being a direction that is parallel to a top surface of the bed and that is orthogonal to the feed direction, the first feed mechanism including:

a first drive pulley that is configured to be rotated by a rotational force of a motor;

a first driven pulley that is separated from the first drive pulley and that is rotatably supported; and a first belt that is provided around the first drive pulley and the first driven pulley and that is configured to be moved by rotation of the first drive pulley, and the second feed mechanism including:

a second drive pulley that is configured to be rotated by the rotational force of the motor;

a second driven pulley that is separated from the second drive pulley and that is rotatably supported; and a second belt having a width different from a width of the first belt in the first direction that is provided around the second drive pulley and the second driven pulley and that is configured to be moved by rotation of the second drive pulley;

a mechanism arrangement portion that is configured to arrange the first feed mechanism and the second feed mechanism in different positions in a second direction, the second direction being a direction orthogonal to the top surface of the bed, the mechanism arrangement portion including:

a first biasing portion that is configured to bias the first driven pulley toward a top surface of the work cloth; and a second biasing portion that is configured to bias the second driven pulley toward the top surface of the work cloth; and a drive portion that includes the motor and is configured to drive the first feed mechanism and the second feed mechanism of the feed portion in synchronization.

2. A sewing machine comprising:

a bed; and an upper feed device that is arranged above the bed and that is configured to feed a work cloth, the upper feed device including:

a feed portion that includes a first feed mechanism and a second feed mechanism and that is configured to feed the work cloth in a feed direction, the first feed mechanism and the second feed mechanism being arranged side by side in a first direction, and the first direction being a direction that is parallel to a top surface of the bed and that is orthogonal to the feed direction, the first feed mechanism including:

a first drive pulley that is configured to be rotated by a rotational force of a motor;

a first driven pulley that is separated from the first drive pulley and that is rotatably supported; and a first belt that is provided around the first drive pulley and the first driven pulley and that is configured to be moved by rotation of the first drive pulley, and the second feed mechanism including:

a second drive pulley that is configured to be rotated by the rotational force of the motor;

a second driven pulley that is separated from the second drive pulley and that is rotatably supported; and a second belt having a width different from a width of the first belt in the first direction that is provided around the second drive pulley and the second driven pulley and that is configured to be moved by rotation of the second drive pulley;

a mechanism arrangement portion that is configured to arrange the first feed mechanism and the second feed mechanism in different positions in a second direction, the second direction being a direction orthogonal to the top surface of the bed, the mechanism arrangement portion including:

a first biasing portion that is configured to bias the first driven pulley toward a top surface of the work cloth; and a second biasing portion that is configured to bias the second driven pulley toward the top surface of the work cloth; and a drive portion that includes a motor and is configured to drive the first feed mechanism and the second feed mechanism of the feed portion in synchronization.

3. The sewing machine according to claim 2, further comprising:

a needle bar; and a needle bar drive portion that is configured to change a baseline position within a predetermined range in the first direction, the baseline position indicating a needle drop point of a sewing needle that is attached to the needle bar, wherein the first belt is configured to press stitches that are formed on the work cloth in a first baseline position, the first baseline position being located on one side, in the first direction, within the predetermined range, and the second belt is configured to press stitches that are formed on the work cloth in at least one of a second baseline position and a third baseline position, the second baseline position being located on the other side, in the first direction, within the predetermined range, and the third baseline position being located in a center, in the first direction, of the predetermined range.

* * * * *